US006279555B1

(12) United States Patent
Crowell et al.

(10) Patent No.: US 6,279,555 B1
(45) Date of Patent: Aug. 28, 2001

(54) BLOW-BY GAS EVACUATION AND OIL RECLAMATION

(75) Inventors: Thomas J. Crowell, Peoria; Douglas E. Wilson, Henry, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/652,171

(22) Filed: Aug. 31, 2000

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS

| | | | | |
|---|---|---|---|---|
| 3,589,347 | * | 6/1971 | Sawada | 123/572 |
| 3,978,671 | * | 9/1976 | Gonzalez | 123/41.86 |
| 4,106,442 | | 8/1978 | Miller . | |
| 4,257,383 | | 3/1981 | Boswell . | |
| 4,305,369 | | 12/1981 | Norman . | |
| 4,557,226 | * | 12/1985 | Mayer et al. | 123/41.86 |
| 4,703,726 | | 11/1987 | Sekiya et al. . | |
| 4,856,487 | | 8/1989 | Furuya . | |
| 4,881,511 | | 11/1989 | Pickering . | |
| 4,947,806 | | 8/1990 | Speer et al. . | |
| 4,962,745 | * | 10/1990 | Ohno et al. | 123/572 |
| 5,228,424 | | 7/1993 | Collins . | |
| 5,347,973 | | 9/1994 | Walker, Jr. . | |
| 5,611,204 | | 3/1997 | Radovanovic et al. . | |
| 5,722,376 | | 3/1998 | Sweeten . | |
| 6,148,807 | * | 11/2000 | Hazen | 123/572 |

* cited by examiner

*Primary Examiner*—Marguerite McMahon
(74) *Attorney, Agent, or Firm*—Eric M. Bram; Keith P. Roberson

(57) ABSTRACT

Air laden with oil and blow-by gases is evacuated from an engine compartment such as a crankcase. The air is cleaned by removing oil and may be reused for engine combustion by routing it through a turbocharger inlet. The reclaimed oil may be returned to an oil pan for reuse in engine lubrication.

12 Claims, 1 Drawing Sheet

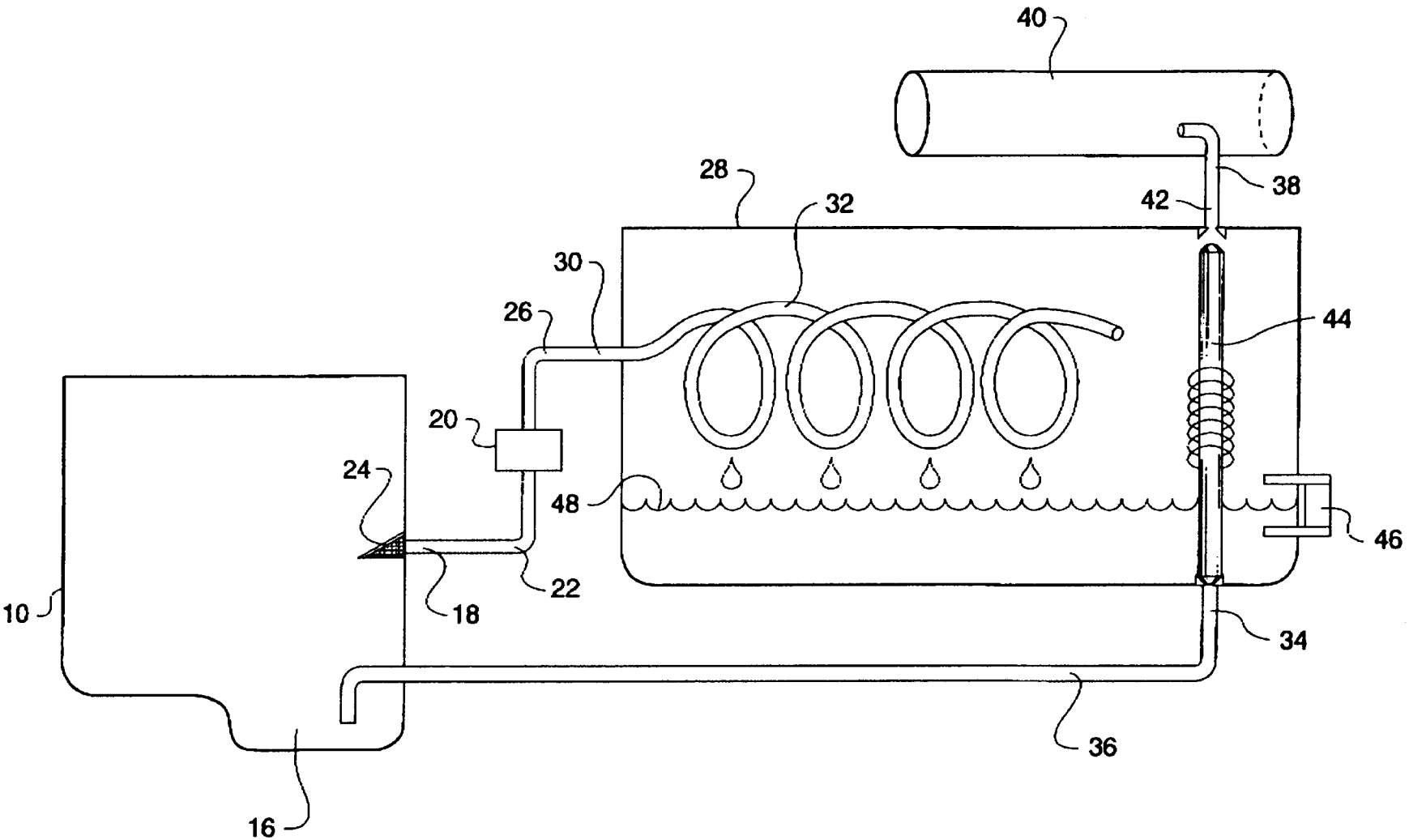
46
44
38
34
42
36
40
32
28
30
48
22
26
20
18
24
16
10

BLOW-BY GAS EVACUATION AND OIL RECLAMATION

TECHNICAL FIELD

This invention relates generally to engines, and more particularly to removing oil vapor and/or reclaiming oil from engine crankcase blow-by.

BACKGROUND ART

Potentially harmful pollutants are often produced within a crankcase of an internal combustion engine during operation. These pollutants are present in combustion waste gases, known as "blow-by" gases, that leak past the engine piston rings into the crankcase, where they mix with air that usually includes oil vapor from the engine.

These gases must be allowed to leave the crankcase, to prevent oil vapor from leaking back past the piston rings. The gases increase pressure in the crankcase if left therein. The excess pressure can cause seals to leak and affects normal engine operation in a negative manner.

If the blow-by is merely vented through a road draft tube for example into the atmosphere, the pollutants contribute to air pollution, and engine oil is lost as well.

An alternative approach in handling blow-by has been to pass it through a positive crankcase ventilation (PCV) valve into the intake manifold for recombustion in the engine's combustion chamber, in response to a changing pressure within the crankcase. This can cause different pollutants to be generated by the engine, which also contributes to air pollution. In addition, diverting blow-by into the intake system causes the oily mixture to stick along the walls of the intake manifold and head. Additionally, the oily mixture can cause valve fouling.

Various solutions have been tried. One approach is to route blow-by gases through a filter to remove oil in the oil vapor and other pollutants, such as taught in U.S. Pat. No. 5,722,376 to Sweeten for example. The filter must be periodically changed, however, and oil is lost when the used filter is discarded.

This invention is directed to addressing one or more of the above concerns.

DISCLOSURE OF THE INVENTION

In a first aspect of the invention, a blow-by gas evacuation and oil reclamation system includes an engine compartment, a pump, and an oil separation chamber. The engine compartment has a pump inlet leading to the pump. The pump has a pump outlet leading to the oil separation chamber. The oil separation chamber includes an oil vapor separator, a gas outlet, and a liquid outlet leading to the engine compartment.

In another aspect of the invention, a blow-by gas evacuation and oil reclamation method for an engine includes routing oil-laden air from a crankcase of the engine to an oil separation chamber; separating the oil-laden air into separated oil and separated air that is cleaner than the oil-laden air; and returning the separated oil to the crankcase.

In yet another aspect of the invention, a method for reclaiming oil and evacuating blow-by gases from an engine compartment includes evacuating engine air from the engine compartment, the engine air including a mixture of the blow-by gases and oil vapor; cleaning the evacuated engine air, including reclaiming liquid oil from the evacuated engine air by removing oil vapor from the engine air, resulting in cleansed air having a reduced oil vapor content; diverting the cleansed air to be reused in engine combustion; and diverting the reclaimed liquid oil to an oil receptacle and using the reclaimed liquid oil to lubricate the engine.

BRIEF DESCRIPTION OF THE DRAWING

The drawing is a diagrammatic representation of a blow-by gas evacuation and oil reclamation system according to the invention.

BEST MODE FOR CARRYING OUT THE INVENTION

With reference to the drawing, an engine compartment, a crankcase 10 associated with a cylinder head and an engine block for example, has engine air including oil-laden air (blow-by) therein. (For ease of reference, the term "engine air" refers herein to air within the crankcase 10 or similar engine compartment during engine operation.) The crankcase 10 has an oil receptacle, an oil pan 16 for example, and a pump inlet 18 leading to a pump 20. The pump inlet 18 may include a passageway 22, as in the illustrated embodiment, or (in other embodiments) merely a port between the crankcase 10 and the pump 20. A wire mesh screen 24 or membrane 24 may cover an entrance to the pump inlet 18.

The pump 20 has a pump outlet 26 leading to an oil separation chamber 28. The pump outlet 26 may include a passageway 30, as in the illustrated embodiment, or (in other embodiments) merely a port marking a boundary between the pump 20 and the oil separation chamber 28.

The oil separation chamber 28 houses an oil vapor separator 32. Any type of oil vapor separator may be used, but in the illustrated embodiment the oil vapor separator 32 is a porous coil 32 including baffles and mesh and/or membrane filters. A liquid outlet 34 of the oil separation chamber 28 leads to the oil pan 16. The liquid outlet 34 may include a passageway 36, as in the illustrated embodiment, or (in other embodiments) merely a port marking a boundary between the oil separation chamber 28 and the crankcase 10. The oil separation chamber 28 has a gas outlet 38 that in this embodiment leads to a turbocharger inlet 40. In other embodiments the gas outlet 38 may lead to an engine air intake inlet for a naturally aspirated engine, or may vent to a road draft tube for example. The gas outlet 38 may include a passageway 42, as in the illustrated embodiment, or (in other embodiments) merely a port between the oil separation chamber 28 and the turbocharger inlet 40.

A valve 44, a two-way solenoid valve 44 for example, is cooperatively positioned at the liquid outlet 34 and the gas outlet 38 of the oil separation chamber 28. When the valve 44 is in a first position, fluid communication between the oil separation chamber 28 and the crankcase 10 is closed and the gas outlet 38 of the oil separation chamber 28 is open. When the valve 44 is in a second position, fluid communication between the oil separation chamber 28 and crankcase 10 is open and the gas outlet 38 of the oil separation chamber 28 is closed. A switch 46, a liquid-level proximity switch 46 for example, connects with the valve 44.

INDUSTRIAL APPLICABILITY

Engine air commonly includes blow-by gases and oil vapor from engine lubricating oil. The vacuum pump 20 creates a pressure differential to route the engine air to the oil separation chamber 28. In the illustrated embodiment the engine air first passes through the wire mesh screen 24 or membrane 24 at the pump inlet 18. The screen 24 or membrane 24 can screen out some of the oil from the engine air. The oil that has been screened out from the engine air is separated and returns to the oil pan 16.

When the engine air reaches the oil separation chamber 28 it enters the oil vapor separator 32, which separates oil from the engine air, leaving cleaner air. As the engine air passes through the coil 32, liquid oil will precipitate onto the baffles and filters and pass out of the coil 32 and down to the bottom of the oil separation chamber 28. Consequently the separated air leaving the oil vapor separator 32 is cleaner than the engine air that entered. As the separated oil collects at the bottom of the oil separation chamber 28, the valve 44 is in its first position, closing fluid communication between the oil separation chamber 28 and the crankcase 10 while opening the gas outlet 38 of the oil separation chamber 28.

The pump 20 has raised pressure in the oil separation chamber 28, and consequently the separated air is pushed out the gas outlet 38. The separated air may be vented to the atmosphere or, as in the illustrated closed-circuit system, the separated air may be fed to the turbocharger inlet 40. In this way blow-by gases remaining in the separated air are returned for re-burning in the engine without high levels of oil vapor that can cause turbocharger fouling and other problems associated with high oil vapor levels in engine intake air.

The valve 44 can control whether and when the liquid outlet 34 and the gas outlet 38 of the oil separation chamber 28 are open or closed. The switch 46 can control the valve 44 based on an oil level 48 in the oil separation chamber 28 for example. The separated oil dripping down from the oil vapor separator 32 eventually raises the oil level 48 sufficiently to trigger the switch 46 to operate the valve 44 to begin returning the separated oil to the crankcase 10. To do this the valve is moved to its second position, opening fluid communication between the oil separation chamber 28 and the crankcase 10 while closing the gas outlet 38 of the oil separation chamber 28. The pressure in the oil separation chamber 28 then pushes the separated oil through the liquid outlet 34 to the crankcase 10 where it can drain to the oil pan 16.

This continues until the oil level 48 drops enough to trigger the switch 46 to cause the valve 44 to move back to its first position, where it stays until the oil level 48 rises once again. In this way the valve 44 is operated to periodically and/or intermittently alternate between feeding the separated air to the turbocharger inlet 40 and returning the separated oil to the crankcase 10.

The invention is not limited to the disclosed embodiments. For example, some embodiments may not use a turbocharger. As another example, in the illustrated embodiment a single valve controls opening and closing of the liquid outlet 34 and the gas outlet 38, only one of which is open at any given time. In other embodiments the two outlets may be controlled independently by a multi-position valve or by more than one valve.

Similarly, while in the illustrated embodiment the vacuum pump 20 creates a pressure differential to route the engine air to the oil separation chamber 28, in other embodiments the engine air could be routed to the oil separation chamber 28 by a pressure differential caused by low pressure at the gas outlet 38, or even by the higher pressure in the crankcase 10 caused by the blow-by gases themselves, while using gravity to return liquid oil to the oil pan 16. Countless other variations to the disclosed embodiments can also be made by those skilled in the art while practicing the claimed invention.

Accordingly, while the invention has been illustrated and described in detail in the drawings and foregoing description, such illustration and description are to be considered illustrative or exemplary and not restrictive; other variations to the disclosed embodiments can be made by those skilled in the art while practicing the claimed invention from a study of the drawings, the disclosure, and the appended claims.

What is claimed is:

1. A blow-by gas evacuation and oil reclamation system, comprising:

an engine compartment having a pump inlet leading to a pump;

the pump having a pump outlet leading to an oil separation chamber;

the oil separation chamber including an oil vapor separator, a gas outlet, and a liquid outlet leading to an oil receptacle; and a valve movable between a first position and a second position, in said first position said valve closes the liquid outlet leading to the oil receptacle and opens said gas outlet of said oil separation chamber, in said second position said valve opens the liquid outlet leading to the oil receptacle and closes said gas outlet of said oil separation chamber.

2. The system of claim 1, wherein the gas outlet connects with a turbocharger inlet.

3. The blow-by gas evacuation and oil reclamation system of claim 1 further comprising a switch being adapted to create a signal indicative of oil level in said oil separation chamber.

4. The blow-by gas evacuation and oil reclamation system of claim 3 wherein said valve being operated responsively to said signal indicative of oil level.

5. A blow-by gas evacuation and oil reclamation method for an engine, comprising:

routing oil-laden air from an engine chamber to an oil separation chamber;

separating the oil-laden air within the oil separation chamber into separated oil and separated air that is cleaner than the oil-laden air; and operating a valve between a first position and a second position wherein said first position allows fluid communication between said oil separation chamber and an oil receptacle while said valve prevents fluid communication from an air outlet on said oil separation chamber.

6. The method of claim 5, wherein routing the oil-laden air to the oil separation chamber is accomplished using a pump.

7. The method of claim 5, including feeding the separated air to a turbocharger inlet where said valve in said second position.

8. The method of claim 5, including operating the valve based on a level of fluid oil including the separated oil within the oil separation chamber.

9. A method for reclaiming oil and evacuating blow-by gases from an engine compartment, comprising:

evacuating engine air, including blow-by gases and oil vapor, from the engine compartment;

cleaning the evacuated engine air, including reclaiming liquid oil from the evacuated engine air by removing oil vapor from the engine air, resulting in cleansed air having a reduced oil vapor content; and alternating between diverting the cleansed air to be reused in engine combustion and diverting the reclaimed liquid oil to the oil receptacle.

10. The method of claim 9, wherein evacuating the engine air from the engine compartment is accomplished through suction provided by a pump.

11. The method of claim 9, including diverting the cleansed air to a turbocharger inlet.

12. The method for reclaiming oil and evacuating blow-by gases from an engine compartment of claim 9 wherein said altering step is in response to an oil level.

* * * * *